US005933880A

United States Patent [19]

Huang

[11] Patent Number: 5,933,880

[45] Date of Patent: Aug. 10, 1999

[54] ASSEMBLED TOILET BOWL

[76] Inventor: Hsien-Tu Huang, 6F, No.96, Liu-Kuei Road, Ta-Li City, Taichung Hsien, Taiwan

[21] Appl. No.: 09/169,998

[22] Filed: Oct. 13, 1998

[51] Int. Cl.[6] ..... E03D 11/00

[52] U.S. Cl. ..... 4/420; 4/434; 4/441

[58] Field of Search ..... 4/420, 424, 434, 4/441, 415, 326

[56] References Cited

U.S. PATENT DOCUMENTS

| | | | |
|---|---|---|---|
| 3,877,082 | 4/1975 | Wilhelm | 4/326 |
| 4,499,617 | 2/1985 | Wilhelm | 4/441 |
| 5,548,850 | 8/1996 | Geeham | 4/434 |

*Primary Examiner*—David J. Walczak
*Attorney, Agent, or Firm*—Rosenberg, Klein & Bilker

[57] ABSTRACT

An assembled toilet bowl mainly includes a seat section, a base and a valve cover set. When activating a flushing control member, the valve cover is opened. The water from the water source will flow through a water incoming passage of the seat section and a bowl-shaped space. Then the water will horizontally flow through a valve port and then flow through a draining passage of the base and downward flow out. Reversely, when the flushing control member is not activated, the valve cover is closed. Under such circumstance, the water of the water source will not flow out and the valve cover will block the valve port to isolate the draining passage. Therefore, the toilet bowl can save more water, can be fixed on a wall, can be easily assembled, and can be easily cleaned.

6 Claims, 6 Drawing Sheets

ASSEMBLED TOILET BOWL

BACKGROUND OF THE INVENTION

The present invention relates to an assembled toilet bowl which is able to save water and space. In addition, the assembled toilet bowl is easier to assemble, maintain and wash than the conventional toilet bowl.

FIGS. 1 and 2 show a conventional toilet bowl which has some shortcomings as follows:

1. Generally, the toilet bowl is installed immediately adjacent to the water tank 11. Such toilet bowl 1 has a considerably large base section 14 which results in a large volume of the toilet bowl. Such volume occupies much room of the toilet which often has limited space.

2. Referring to FIG. 2, in the S-way 12 of the toilet bowl, the water level must be kept at a height H. A partitioning section 15 is immersed in the water in order to prevent the odor from leaking out from the exit 13 through the S-way 12 to the toilet room. Therefore, in order to flush away the solid excretion in the toilet bowl, a considerably great flushing force of the fluid is necessary for moving the excretion up to the height H from the lower section 121 of the S-way through the upper section 122 to be discharged downward.

3. Referring to FIG. 1, when it is necessary to install a new toilet bowl, the floor tiles of the area on which the toilet bowl is to be installed must be removed according to the size of the base section 14 of the toilet bowl 1. Then the toilet bowl 1 is installed in alignment with the discharging hole 91 formed on the ground 9. It is difficult to recover the broken floor tiles and the appearance will be deteriorated.

4. The S-way 12 of the conventional toilet bowl 1 includes a lower section 121 (with water) and an upper section 122 (without water). In the case that an alien article (such as a comb, a towel, a toothbrush, etc.) is dropped and stuck in the S-way, a general toilet bowl opener can hardly clear the alien article.

5. The conventional toilet bowl can be hardly assembled by a user himself. Moreover, the conventional toilet bowl cannot be adjusted in height.

6. The S-way 12 of the conventional toilet bowl has an upper section 122 which can be hardly washed.

SUMMARY OF THE INVENTION

It is therefore a primary object of the present invention to provide an assembled toilet bowl which has smaller volume and can be locked on a lateral wall without occupying much room.

It is a further object of the present invention to provide the above toilet bowl in which the draining passage is substantially horizontal so that less water is needed for flushing clean the excretion.

It is still a further object of the present invention to provide the above toilet bowl which is installed without damaging the floor tiles.

It is still a further object of the present invention to provide the above toilet bowl which can be easily assembled and disassembled for maintenance. In addition, the inner side of the toilet bowl can be easily washed.

The present invention can be best understood through the following description and accompanying drawings, wherein:

DETAILED DESCRIPTION OF THE PREFERRED EMBODIMENTS

Figure 1:
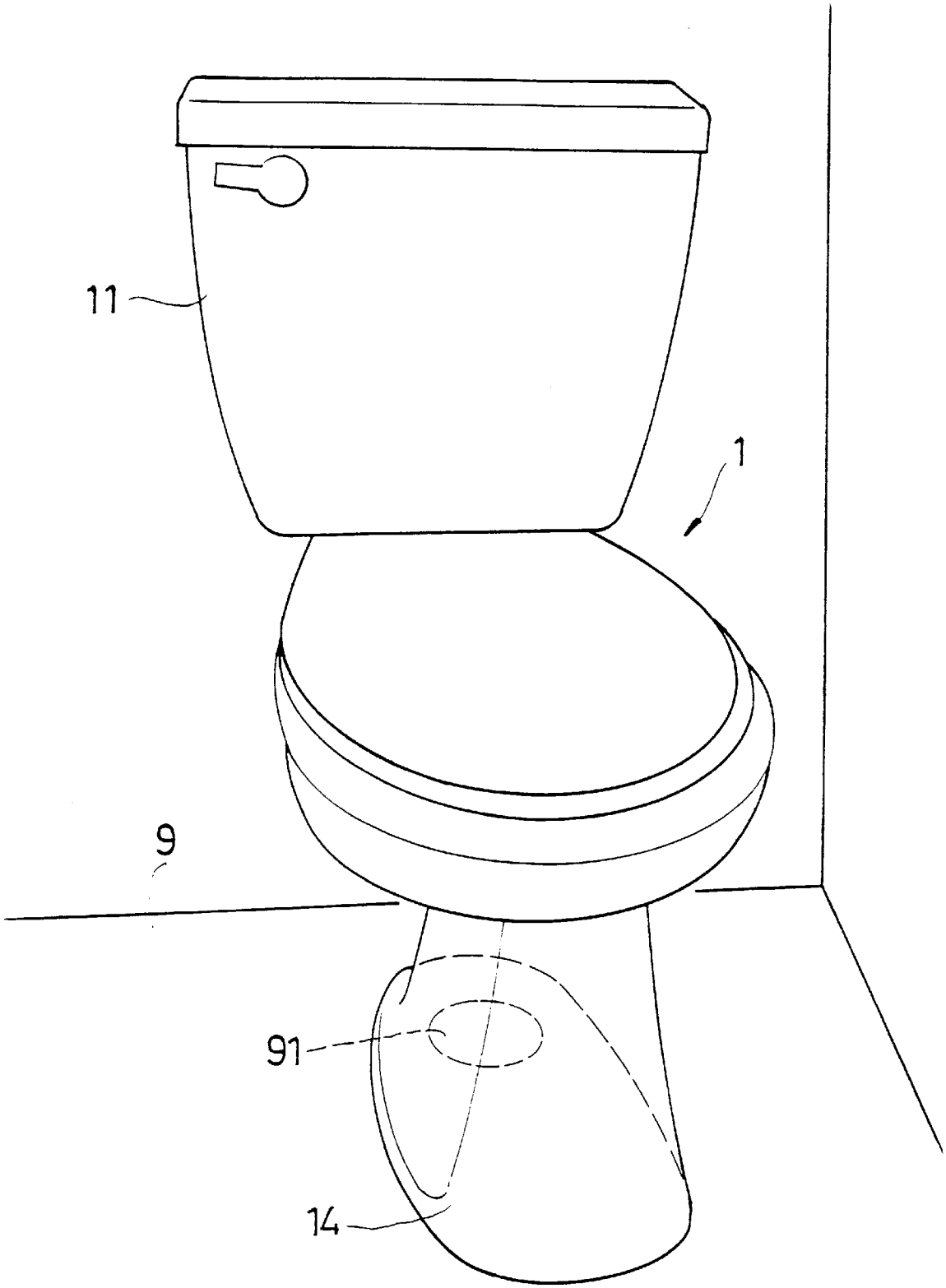
FIG. 1 PRIOR ART
FIG. 1 is a perspective view of a conventional toilet bowl.
Figure 2:
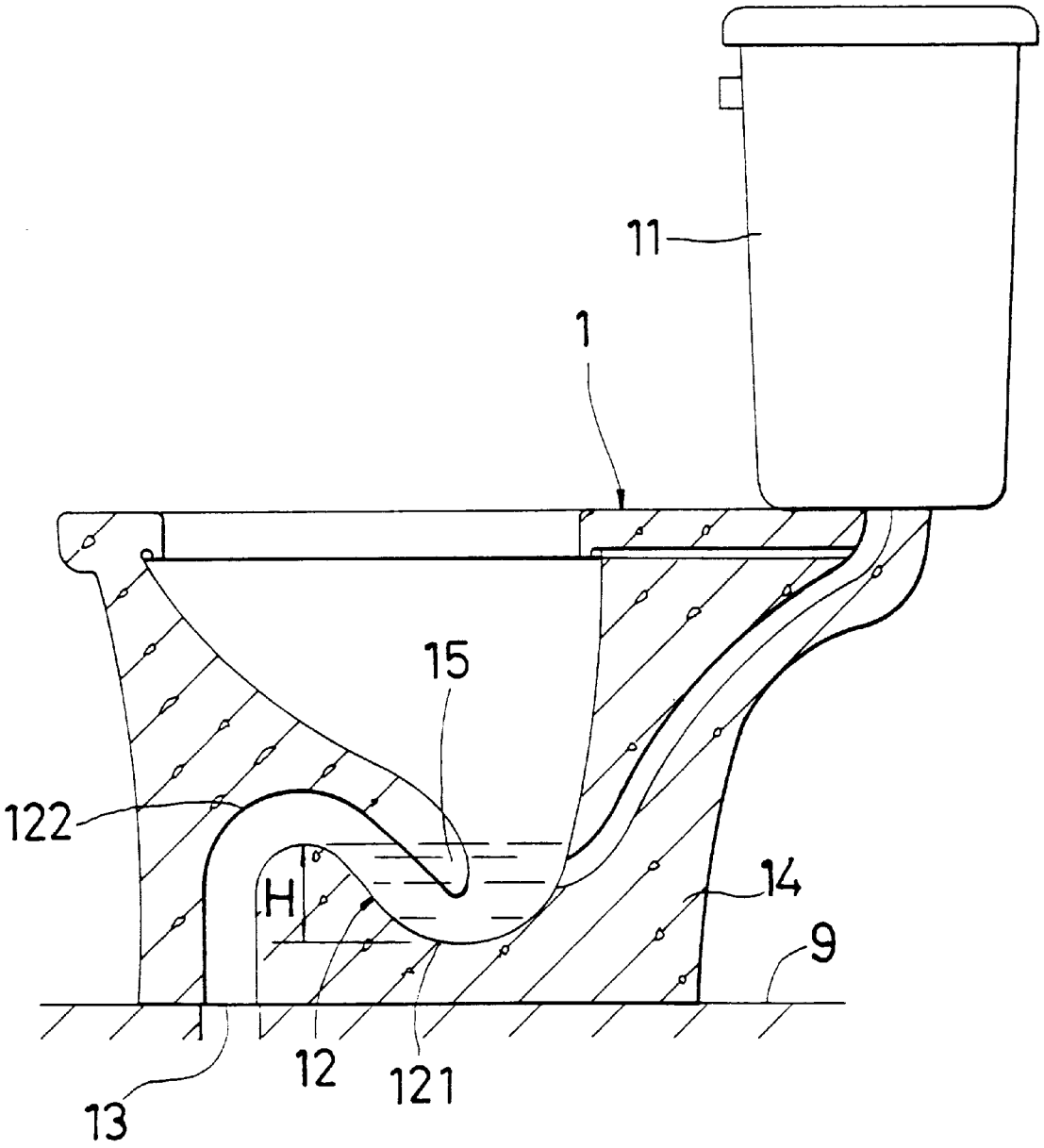
FIG. 2 PRIOR ART
FIG. 2 is a sectional view showing the internal structure of the conventional toilet bowl.
Figure 3:
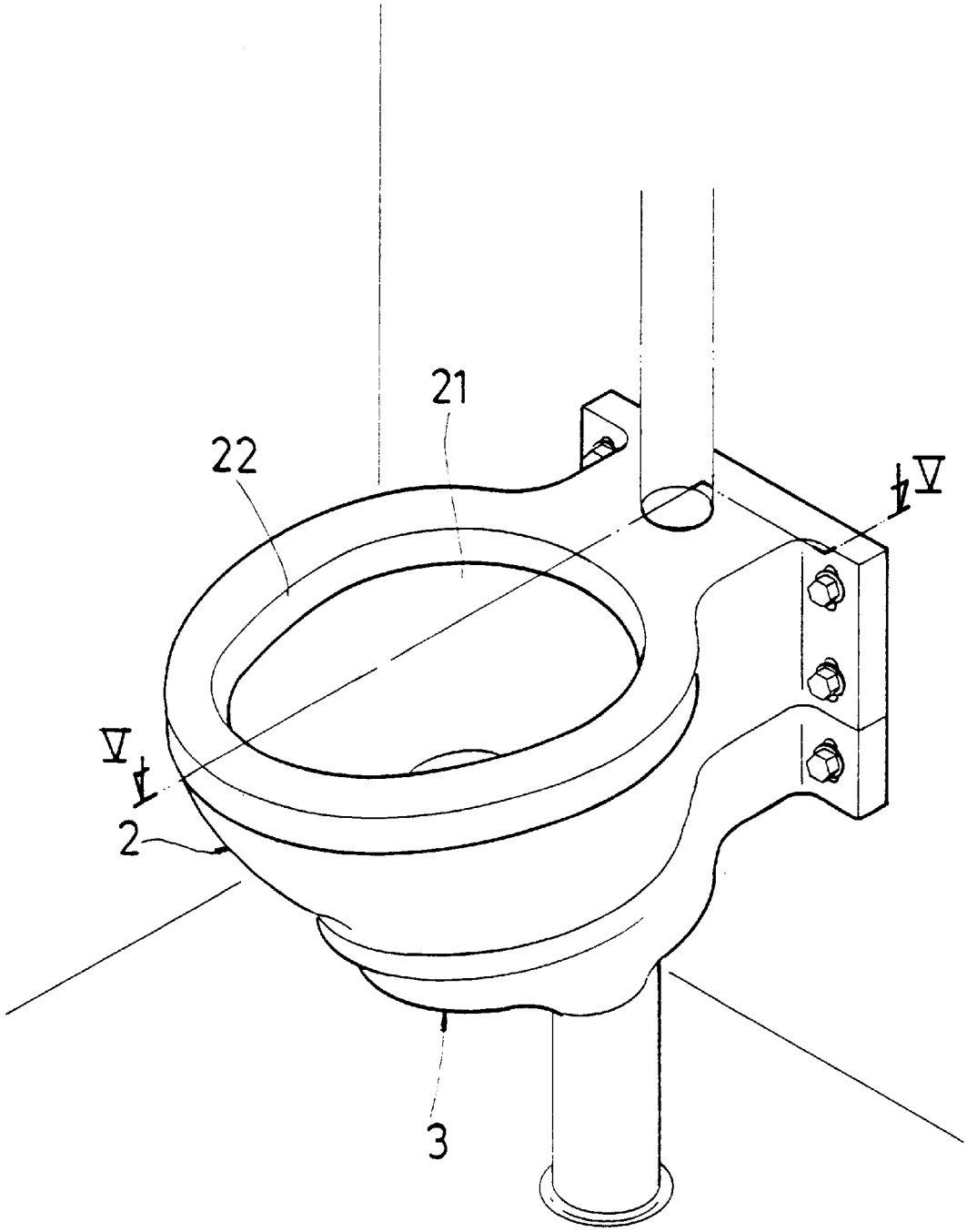
FIG. 3 is a perspective assembled view of the present invention.
Figure 4:
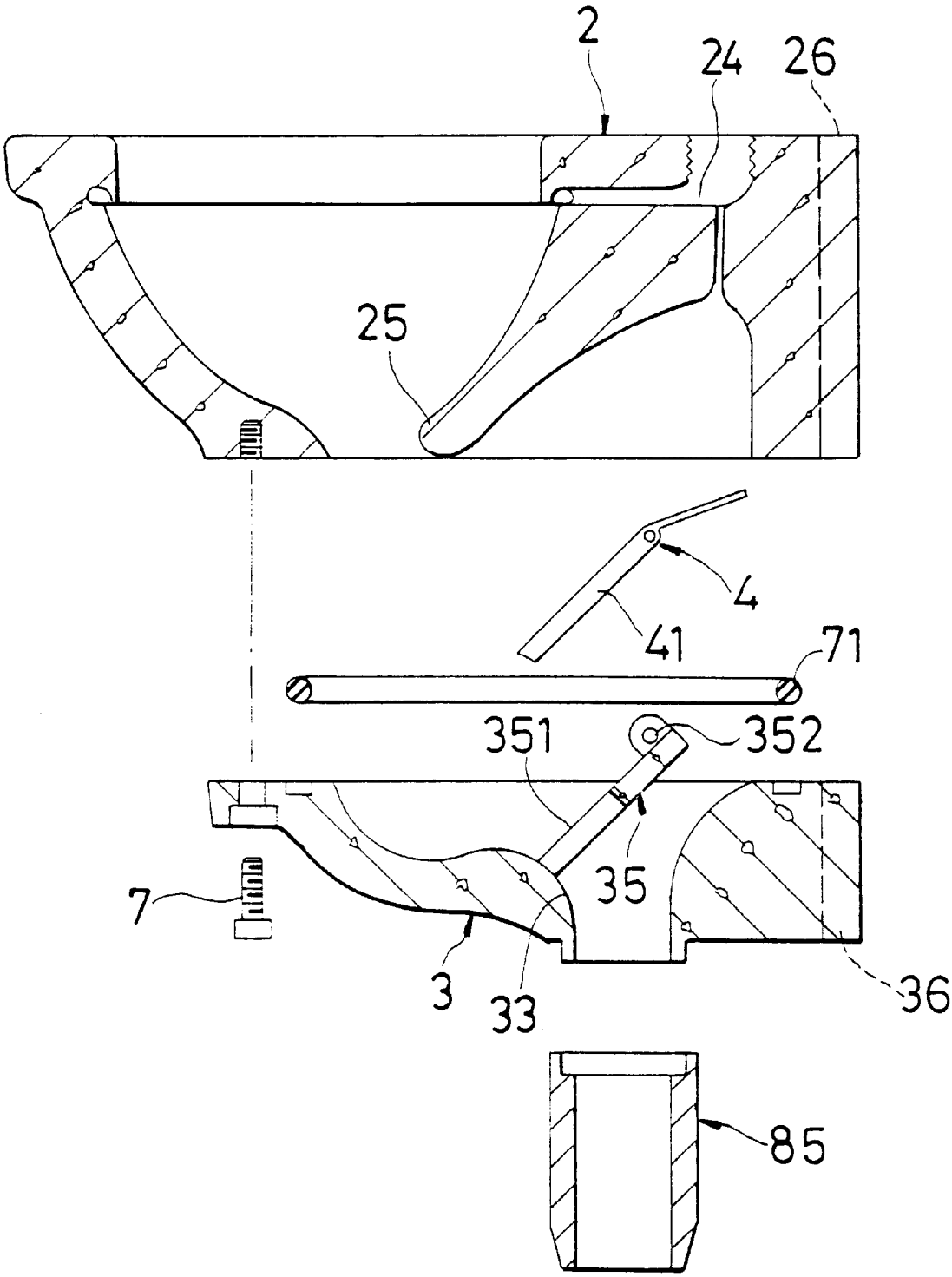
FIG. 4 is a sectional exploded view of the present invention.
Figure 5:
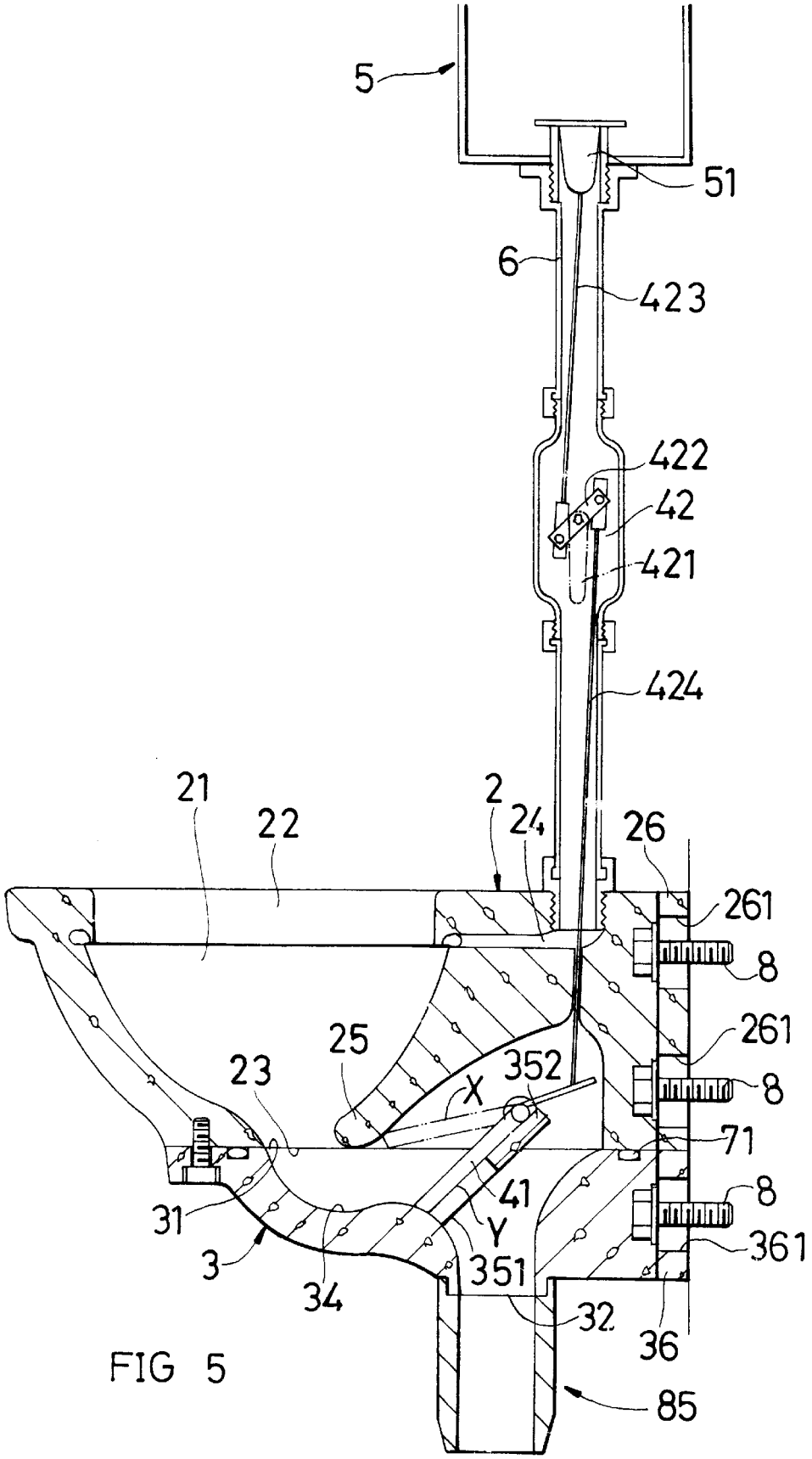
FIG. 5 is a sectional view showing the internal structure the present invention.

Please refer to FIGS. 3 to 5. The assembled toilet bowl of the present invention includes a seat section 2, a base 3 and a valve cover set 4.

The seat section 2 is formed with a central bowl-shaped space 21, a first opening 22 on the top face thereof, a second opening 23 on the bottom face, a water incoming passage 24 for guiding water into the space 21, a partitioning section 25 and a seat fixing section 26.

The base 3 has a third opening 31 on the top face for communicating with the second opening 23, a draining opening 32 at the bottom, a draining passage 33 connected to the third opening 31 and the draining opening 32, a dented section 34 formed right under the third opening 31 of the draining passage 33 for temporarily storing the excretion of a user, an inclined plate section 35 positioned at the center of the draining passage 33 and disposed with a valve port 351 and a pivot section 352 and a base fixing section 36. The seat section 2 and the base 3 are locked with each other by multiple fixing members 7 which can be bolts, latch hooks, etc.

The valve cover set 4 includes a valve cover 41 and a flushing control member 42. The valve cover 41 is pivotally disposed on the pivot section 352 of the inclined plate section 35 of the base 3. By means of controlling the opening/closing of the valve port 351 of the inclined plate section 35, the draining passage 33 is opened or closed. The flushing control member 42 serves to control the flushing operation and opening/closing of the valve cover 41.

Accordingly, when activating the flushing control member 42, the valve cover 41 is opened to a first position X. The water from the water source will flow through the water incoming passage 24 of the seat section 2 and the bowl-shaped space 21. Then the water will horizontally flow through the valve port 351 and then flow through the draining passage 33 of the base 3 and downward flow out. Reversely, when the flushing control member 42 is not activated, the valve cover 41 is closed at the second position Y. Under such circumstance, the water of the water source will not flow out and the valve cover 41 will block the valve port 351 to isolate the draining passage 33. Therefore, the water is prevented from flowing out. On the other hand, the partitioning section 25 is immersed in the water so that the odor of the septic tank is prevented from leaking outside.

A portion of the draining passage 33 between the dented section 34 and the valve port 351 of the inclined plate section 35 is substantially horizontal. Therefore, the solid excretion can be easily flushed away. In estimation, only one half (50%) of the conventionally used water will be sufficient for flushing clean the excretion.

Basically, the seat fixing section 26 and the base fixing section 36 are both formed with at least one pair of slots 261, 361 and disposed with multiple lateral wall fixing members 8 for height-adjustably fixing the toilet bowl on a lateral.

In addition, the present invention can further include:

a water tank 5 positioned above the seat section 2 by a certain distance and the higher the position of the water tank 5 is, the less the amount of the flushing water is; and a flushing tube 6 communicating with the water tank 5 and the water incoming passage 24 of the seat section 2.

The flushing control member 42 includes a turnable gravity handle 421, a controlling lever section 422, a top lever 423 and a bottom lever 424. The gravity handle 421 is exposed outside the flushing tube 6, while the controlling lever section 422 is disposed in the flushing tube 6 and connected to the bottom lever 424 for controlling the valve cover 41 and connected to the top lever 423 for controlling a water sealing plug 51 of the water tank 6. In normal time, the gravity handle 421 has a predetermined weight and naturally suspends. At this time, the valve cover 41 and the water sealing plug 51 controlled by the flushing control member 42 are both closed without flushing. When the gravity handle 421 is rotated, the valve cover 41 and water sealing plug 51 controlled by the flushing control member 42 are opened at the same time for flushing.

Figure 6:
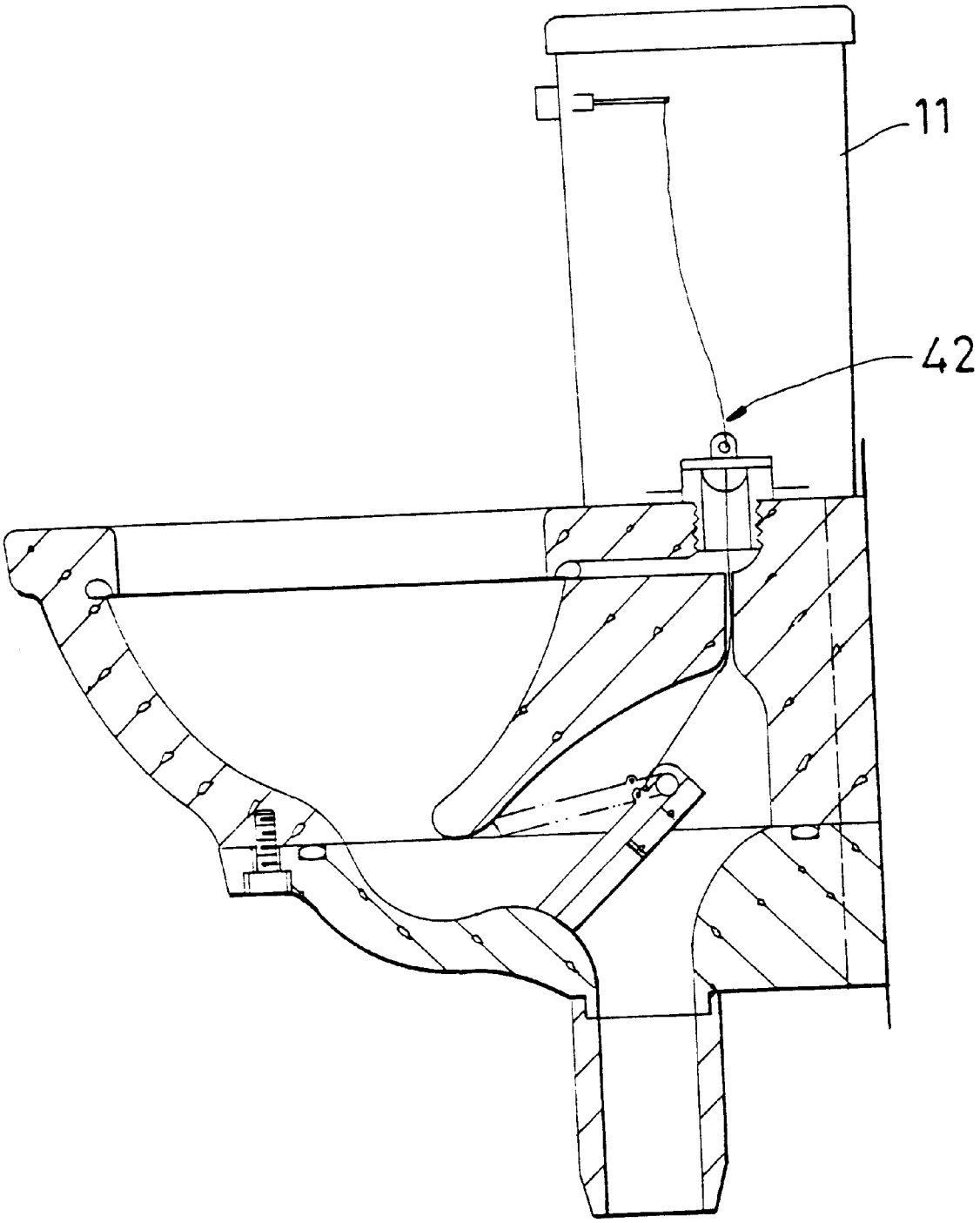
FIG. 6 shows a second embodiment of the present invention.

FIG. 6 shows a second embodiment of the present invention, which is used in cooperation with a conventional water tank 11. When the flushing control member 42 (such as a handle, a linking lever, a water sealing plug and a cord) is pulled up, the flushing operation can be also achieved.

The water incoming passage 24 serves to guide the water from the water source to flow along the wall face of the bowl-shaped space to form a swirl so as to achieve an even better flushing effect and silence.

In addition, the present invention can be made of non-ceramic material such as aluminum or plastic steel which is often used in an aircraft or a boat and the cost of which is not higher than that of the ceramic material. Such materials have sufficient strength. Moreover, in the case of metal-made toilet bowl, the thickness of the respective sections of the toilet bowl can be reduced and used toilet bowl can be recovered and recycled.

In practice, an annular soft pad member 71 (preferably made of rubber material) is sandwiched between the bottom face of the seat section 2 and the top face of the base 3 so as to enhance the sealing effect. The slots 261, 361 permit the present invention to be micro-adjusted in height. In addition, a connecting tube assembly 85 is added between the draining opening 32 and the ground.

The present invention has the following advantages:

1. The toilet bowl is hung and locked on a lateral wall so that the toilet bowl does not need a large volume in consideration of the necessary height. Moreover, the water tank can be hung at a high position without occupying room.

2. The water can be saved by about one half. The valve port of the present invention is lower than the conventional height H of the S-way, so that the water flows horizontally instead of upward flowing. Accordingly, less amount-of water will be sufficient for flushing.

3. The toilet bowl can be easily installed without damaging the floor tiles. The toilet bowl only needs to be aligned with the hole 91 and locked on the lateral wall.

4. In the case that the toilet bowl is blocked by an alien article, the toilet bowl can be disassembled for maintenance.

5. The toilet bowl can be assembled by a user himself. In addition, through the design of the slots, the height of the toilet bowl can be adjusted as necessary.

6. The inner side of the toilet bowl can be easily washed.

It is to be understood that the above description and drawings are only used for illustrating some embodiments of the present invention, not intended to limit the scope thereof. Any variation and derivation from the above description and drawings should be included in the scope of the present invention.

What is claimed is:

1. An assembled toilet bowl comprising:

a seat section formed with a central bowl-shaped space, a first opening on a top face of the seat section, a second opening on a bottom face of the seat section, a water incoming passage for guiding water into the space, a partitioning section and a seat fixing section;

a base having a third opening on a top face of the base for communicating with the second opening, a draining opening at a bottom of the base, a draining passage connected to the third opening and the draining opening, a dented section formed right under the third opening of the draining passage, an inclined plate section positioned at an center of the draining passage and disposed with a valve port and a pivot section and a base fixing section, the seat section and the base being locked with each other by multiple fixing members; and a valve cover set including a valve cover and a flushing control member, the valve cover being pivotally disposed on the pivot section of the inclined plate section of the base to thereby control the opening/closing of the valve port of the inclined plate section and thereby opening/closing of the draining passage, wherein the flushing control member serves to control a flushing operation and opening/closing of the valve cover.

2. An assembled toilet bowl as claimed in claim 1, wherein a portion of the draining passage between the dented section and the valve port of the inclined plate section is substantially horizontal.

3. An assembled toilet bowl as claimed in claim 1, wherein the seat fixing section and the base fixing section are both formed with at least one pair of slots and disposed with multiple lateral wall fixing members for height-adjustably fixing the toilet bowl on a lateral wall.

4. An assembled toilet bowl as claimed in claim 1, further comprising:

a water tank positioned above the seat section by a certain distance; and a flushing tube communicating with the water tank and the water incoming passage of the seat section;

wherein the flushing control member includes a turnable gravity handle, a controlling lever section, a top lever and a bottom lever, the gravity handle being exposed outside the flushing tube, the controlling lever section being disposed in the flushing tube and connected to the bottom lever for controlling the valve cover and connected to the top lever for controlling a water sealing plug of the water tank.

5. An assembled toilet bowl as claimed in claim 1, wherein the water incoming passage serves to guide the water from water source to flow along a wall face of the bowl-shaped space to form a swirl.

6. An assembled toilet bowl as claimed in claim 1, wherein a pad member is sandwiched between the bottom face of the seat section and the top face of the base.

* * * * *